US012448198B2

(12) United States Patent
Borbon

(10) Patent No.: US 12,448,198 B2
(45) Date of Patent: Oct. 21, 2025

(54) CLIMATE CONTROL JAR

(71) Applicant: Lenny Paul Borbon, Corona, NY (US)

(72) Inventor: Lenny Paul Borbon, Corona, NY (US)

( * ) Notice: Subject to any disclaimer, the term of this patent is extended or adjusted under 35 U.S.C. 154(b) by 0 days.

(21) Appl. No.: 18/424,480

(22) Filed: Jan. 26, 2024

(65) Prior Publication Data

US 2024/0317479 A1 Sep. 26, 2024

Related U.S. Application Data

(60) Provisional application No. 63/491,924, filed on Mar. 23, 2023.

(51) Int. Cl.

| | |
|---|---|
| ***B65D 81/26*** | (2006.01) |
| ***A24F 23/00*** | (2006.01) |
| ***A24F 25/02*** | (2006.01) |
| ***B65D 43/02*** | (2006.01) |
| ***B65D 81/20*** | (2006.01) |

(52) U.S. Cl.

CPC ..... *B65D 81/2076* (2013.01); *A24F 23/00* (2013.01); *A24F 25/02* (2013.01); *B65D 43/02* (2013.01); *B65D 81/264* (2013.01)

(58) Field of Classification Search

CPC ..... A24F 23/00; A24F 25/02; B65D 81/266; B65D 81/268; B65D 81/264; B65D 81/2076; B65D 81/22; B65D 51/30; B65D 2543/00092; B65D 43/02

USPC ..... 131/250; 206/223, 528; 220/522, 521; 215/228

See application file for complete search history.

(56) References Cited

U.S. PATENT DOCUMENTS

| | | | |
|---|---|---|---|
| 3,081,137 | A | 3/1963 | Kolokythas |
| 4,350,508 | A | 9/1982 | Santoro et al. |
| 6,158,580 | A | 12/2000 | Davis |
| 7,413,083 | B2 | 8/2008 | Belfance et al. |
| 9,968,130 | B2 | 5/2018 | Potter et al. |

(Continued)

FOREIGN PATENT DOCUMENTS

WO 2020153507 7/2020

OTHER PUBLICATIONS

N/A, Kerr Humidity Control Jar | 32oz Wide Mouth Mason Jar |6 pack Integra Boost Humidity Control, May 3, 2022.

(Continued)

*Primary Examiner* — King M Chu
(74) *Attorney, Agent, or Firm* — Alan M. Sack, Esq.; John F. Vodopia, Esq.; SACK IP Law p.c.

(57) ABSTRACT

A climate control container maintains herbs fresh for extended periods of time. The container includes a container part with a cylindrical wall attached to a base forming an internal volume for herbs. A top, climate control part connects to the cylindrical wall of the container part. A layering system is placed in an upper portion of the internal volume that includes plates in a top-down vertical arrangement. The plates are formed with unique respective patterns of through-holes to limit air movement. A top cover part makes an air-tight connection to the cylindrical wall and/or the top, climate control part. Air-tight connecting the top, climate control part to the container part with the layering system and to the top cover part effects an air lock sealing the internal volume to air flow in or out and controls air flow through the vertical arrangement to limit air turbulence.

21 Claims, 20 Drawing Sheets

(56) References Cited

U.S. PATENT DOCUMENTS

| | | | | |
|---|---|---|---|---|
| 10,246,241 | B2 | 4/2019 | Logel et al. | |
| 10,913,585 | B2 | 2/2021 | Longacre et al. | |
| 2007/0084735 | A1 | 4/2007 | Lancesseur | |
| 2010/0140116 | A1* | 6/2010 | Stiene | B65D 81/266 206/459.1 |
| 2016/0031627 | A1* | 2/2016 | Yeh | B65D 81/266 206/204 |
| 2016/0073680 | A1* | 3/2016 | Rushforth | B65D 81/2076 131/300 |
| 2021/0122557 | A1 | 4/2021 | Cohen et al. | |
| 2021/0228442 | A1 | 7/2021 | Medhal et al. | |
| 2022/0073243 | A1* | 3/2022 | Machado | B65D 81/268 |

OTHER PUBLICATIONS

N/A, CVault Humidity Control Airtight Stash Container by—Size: Large (2-8g Boveda Packs Included), May 3, 2022.

* cited by examiner

CLIMATE CONTROL JAR

CROSS REFERENCE TO PRIORITY APPLICATION

This application claims priority of U.S. Provisional Application No. 63/491,924 filed on Mar. 23, 2023, the disclosure of which is incorporated by reference in this application.

BACKGROUND OF THE INVENTION

Field of the Invention

The invention relates broadly to containers for storing herbs, spices and other naturally grown products such as tobacco and marijuana. The invention more particularly relates to a climate control jar that maintains herbs, spices and other naturally grown products such as tobacco and, specifically marijuana fresh for extended periods of time, up to a year or more. The inventive climate control jar has two main systems or features: a humidity control arrangement and an air distribution arrangement.

Background of the Related Art

US Published Appln. No. 2022/0073243 ("the '243 appln"), published Mar. 10, 2022, discloses a modified atmosphere container formed with a body for receiving a product, a lid configured to provide a seal with a body opening, and a cartridge having a defined internal space. An active agent for preserving the freshness of the product may be disposed within the cartridge 16. The cartridge includes a cover label sachet label 26, sachet 28, sachet containment tray 30, and sachet release label 32. The sachet cover label 26 may include a color indicator that changes with the concentration of an agent released by the sachet 28, giving a user a visual indication of the concentration of such agent and, therefore, the potential effectiveness of an assembled cartridge 16. Sachet 28 includes at least one active ingredient held within a permeable container 34. See FIG. 1 of the '243 patent, which is reproduced herein as PRIOR ART FIG. 1.

The '243 application does not describe or suggest a means to limit the airflow between the upper and lower layers and maintain optimal humidity of the stored product. U.S. Pat. No. 10,913,585 ("the '585 patent"), issued Feb. 9, 2021, discloses a container assembly configured to maintain a predetermined humidity for storing a product inside. The '585 patent container assembly includes a container having a body with a body wall and a mouth opening into a storage cavity and a cap having a top wall. The cap is selectively mountable over the mouth of the container to substantially enclose the storage cavity in a mounted configuration. A sidewall extends substantially perpendicularly from one of the body wall and the top wall. The sidewall defines an opening and a compartment and has an opening edge adjacent the opening. See FIG. 13 of the '585 patent, which is reproduced herein as PRIOR ART FIG. 2.

A moisture control material is positioned within the compartment. A sealing membrane has a peripheral portion. The peripheral portion is secured to the sidewall proximate the opening edge. The sealing membrane is configured to allow moisture flow therethrough to maintain the predetermined humidity in the storage cavity, with support from the moisture control material. The moisture control material is positioned within the compartment, and a peripheral portion of the sealing membrane is secured to the sidewall proximate the opening edge. While these features allow moisture flow therethrough in an effort to maintain predetermined humidity, the '585 patent does not describe or suggest a means to limit the airflow between the upper and lower layers to control the environment of the stored product.

U.S. Pat. No. 3,081,137 ("the '137 patent"), issued Mar. 12, 1963, discloses an absorbent storage insert for a container cap to maintain moisture-free storage of powders, capsules, tablets, crystals, granules or other solid substances, particularly in the chemical or pharmaceutical industries. Unwanted moisture can enter the container whenever it is opened to allow a portion of the substance to be removed from the container in which it is stored. That is, water vapor present in the ambient air invariably enters the container and (subsequently) absorbed by the remaining substance, causing lumps or other decomposition therein. Similarly, many substances either contain trace contaminations which have objectionable odors or deteriorate to exhibit odors which may be mitigated or removed by an absorbent such as activated charcoal. See FIG. 1 of the '137 patent, which is reproduced herein as PRIOR ART FIG. 3.

When water and/or odor absorbent material is present in receptacle 11, the material absorbs the water and odor, so that it is not absorbed by or otherwise taints the material stored in the container. The '137 patent, however, does not seek to maintain a humidity level inside the container conducive to storage of marijuana and other herbs, nor include means to limit airflow between the upper and lower layers to control the environment of the stored product.

US Published Appln. No. 2021/0122557 ("the '557 appln"), published Apr. 29, 2021, discloses a bottle insert for absorbing gas or humidity of a bottle. The bottle insert includes a neck adapted to fit against the inside of a neck of the bottle. A first chamber is adapted for storing a first substance; a second chamber is adapted for storing a second substance; and a permeable partition is adapted to be located between an interior of the bottle and at least one of the first chamber and the second chamber. See FIGS. 63 and 64, which are reproduced as PRIOR ART FIGS. 4A and 4B.

FIG. 63 of the '557 application, reproduced as FIG. 4A herein, is a schematic isometric view of an example of a bottle insert 6201 and a bottle. Bottle insert 6200 can be made of a desiccant and at least one additional material. These materials may be mixed to form bottle insert 6201. But while desiccants absorb water, a moisture free internal environment is not conducive to long-term marijuana storage.

US Published Appln. No. 2021/0228442 ("the '442 application"), published Jul. 29, 2021, discloses a medicine container that includes a container body with a bottom wall that at least partially defines an interior of the container body. The bottom wall includes a protrusion extending into the interior. See FIGS. 1 and 2 of the '442 application, which are reproduced as PRIOR ART FIGS. 5A and 5B.

The medicine container also includes a canister base removably couplable to the protrusion. The canister base is further configured to hold a desiccant canister within the interior of the container body when the canister base is coupled to the protrusion. But while the use of desiccants to absorb water in a container, is useful for storage of medicines, it is not conducive for realizing an internal environment that is stable for long-term marijuana storage, which requires a moisture content and control of the humidity of the internal environment of the container.

U.S. Pat. No. 9,968,130 ("the '130 patent"), issued May 15, 2018, discloses a package that may be employed to store a tobacco-containing material. The package includes a container and a valve assembly; the container includes a body portion and a cover configured to engage the body portion. The body portion may define an internal space inside the container. The valve assembly may be configured to affect an atmosphere within the internal space of the container. See FIG. 11 of the '130 patent, which is reproduced as PRIOR ART FIG. 6.

The valve assembly may remain closed except when releasing pressure from the internal space and may vent the container to avoid damage to its contents, while reducing moisture loss from the tobacco-containing material stored in the internal space. But while the valve assembly may define an atmosphere in an internal space in reliance upon a valve assembly, and release pressure in reliance upon a valve assembly, it does not sufficiently control the moisture content and airflow within the container that would be sufficient for long term storage of herbs, such as marijuana.

U.S. Pat. No. 10,246,241 ("the '241 patent"), issued Apr. 2, 2019, discloses a container for receiving moisture sensitive goods. The container includes a container body (15) and a cap (26) shaped to establish a leak-proof seal between the container body and the cap. See FIG. 2 of the '241 patent, which is reproduced as PRIOR ART FIG. 7.

The container body has a base and a sidewall with an insert element present inside the container body having a bottom and an insert sidewall, wherein an outer circumferential surface of the insert sidewall is in contact with an inner circumferential surface of the sidewall of the container body. The bottom of the insert element is permeable to moisture and the insert sidewall and the sidewall of the container body are designed to attach the insert element inside the container body. In addition, the container has a desiccant chamber between the bottom of the insert element and the base of the container body for receiving desiccant material. As explained, while desiccants absorb water, this arrangement does not maintain an internal environment and humidity level that is stable for long term marijuana storage.

U.S. Pat. No. 7,413,083 ("the '083 patent"), issued Aug. 19, 2008, discloses a one-piece vial assembly having a container and cap that provides a substantially moisture-free environment for effervescent tablets, and other items that require packaging and retention in a substantially moisture-free environment. In one embodiment, the container and cap are joined together by a hinge. See FIG. 1 of the '083 patent, which is reproduced as PRIOR ART FIG. 8.

The vial assembly is a one-piece assembly in which the cap is opened and closed in a "flip-top" arrangement, and includes a desiccant entrained plastic, for example, located in a desiccant sleeve, which surrounds at least a portion of the product within the vial assembly sleeve. As explained, while desiccants absorb water, etc., the '083 patent does not maintain an internal environment and humidity level that is stable for long term marijuana storage.

US Published Appln. No. 2007/0084735 ("the '735 application"), published Apr. 19, 2007, discloses a desiccant container with sealing means that provides at least four successive surface to surface type tightness peripheral zones, forming four successive tightness barriers between a casing that houses a product and the lid for the casing. Also disclosed are methods of making the container as well as the uses thereof. See, FIGS. 1-3 of the '735 application, which are reproduced as PRIOR ART FIGS. 9A, 9B and 9C.

According to FIGS. 1 to 3 of the '735 application (FIGS. 9A, 9B and 9C herein), the desiccant container with increased tightness for the packaging of products sensitive to ambient moisture consists of: a tubular casing 1 closed at one of its ends by a base 2 and open at the other end 3 to enable the access of the tubular casing 1 for packaging the moisture-sensitive products, a cap-lid 4, attached to the tubular casing 1 by a removable mechanical hinge 5, a capacity chamber 6 intended to receive the dehydrating agent, this housing being placed on the inner face of the cap-lid 4. As explained, while desiccants absorb water, etc., the '735 application does not disclose a system to maintain an internal environment and humidity level that is stable for long term marijuana storage.

U.S. Pat. No. 4,350,508 ("the '508 patent") discloses a "transparent enclosure" having an internal cavity divided into two portions, the first of which is designed to accept and hermetically seal a container. The second is designed to accept and hold a mixture of a desiccant and a humidity sensitive color indicator. The first and second portions of the cavity are separated by a barrier wall which contains a filter in the central area of the wall.

The filter comprises a porous area in the barrier wall and is formed of a wicking polymer that conducts the humidity within the container to the desiccant and humidity sensitive color indicator, drying the contents of the container and causing the color indicator to provide a visual indication of the humidity within the container. The peripheral surface of the barrier wall engages and seals the barrier wall to physically isolate the contents of the container from the desiccant, while providing a means by which the moisture within the container may be extracted by the desiccant. See FIG. 5C, which is reproduced as PRIOR ART FIG. 10.

As explained, while desiccants absorb water, etc., the '508 patent does not maintain an internal environment and humidity level that is stable for long term marijuana storage.

Int'l Patent Application No. WO 2020/153507 ("the WO '507 application") discloses a cover assembly and a dual container comprising same. In an embodiment, a dual container comprises: a container main body having an opening part and an accommodation space connected to the opening part; and a cover assembly detachably mounted on the container main body so as to open and close the opening part, wherein the cover assembly comprises: a first container having an inlet port through which a desiccant is inputted and a cover member detachably mounted on the container main body and mounted on the first container so as to surround the inlet port of the first container. See FIG. 2 of the WO '507 application, which is reproduced as PRIOR ART FIG. 11.

As explained, while desiccants absorb water, etc., the WO '507 application does not maintain an internal environment and humidity level that is stable for long term marijuana storage.

Non-Patent Publication ("NPP") B0863G1W5H is the sku for a Kerr Humidity Control Jar 32 oz Wide Mouth Mason Jar 6 pack Integra Boost Humidity Control ("B0863G"). The specification for same may be found at the Kerr site: amazon.com/Kerr-Humidity-Control-Mouth-Integra/dp/B0863G1W5H?th=1. FIG. 12 is reproduced from the PRIOR ART NPP B0863G.

The Kerr humidity control jar keeps oxygen out in reliance upon the two-piece lid and band, and the integra boost humidity control packs work by releasing or absorbing moisture. As explained, while keeping oxygen out and maintaining a moisture content may have an effect on the storage of marijuana over the short-term, the Kerr humidity control jar does not control the exchange of air between the humidity pack and the internal space of the mason jar which is needed for the long-term storage of marijuana.

NPP B00IBN4FJA is the sku for CVault Humidity Control Airtight stash container ("B00IBN4 container"). Please see amazon.com/Hyrdofarm-Large-Humidity-Humidor-Container/dp/B00IBN4FJA for the specification, where an image of the PRIOR ART B001BN4 container is reproduced herein as FIG. 13.

The B001BN4 stash container stores 25 to 50 grams of high quality baking herbs, keeping it potent by blocking harmful UVB light which deteriorates potency—unlike glass or plastic baggies which will deteriorate potency by 10% over time. Humidity control inside food grade stainless steel is said to keep plant products fresh, moist and inviting. As explained, while control of moisture and UVB light may have an effect on marijuana potency during storage of marijuana over the short-term, the B001BN4 container does not control the exchange of air between the humidity pack and the internal space of the container which is needed for the long-term storage of marijuana.

SUMMARY OF THE INVENTION

The inventive climate control jar is essentially a uniquely constructed air-tight, climate (humidity) control jar that functions to maintain marijuana, tobacco, herbs, spices, etc., fresh for up to one year with no complications to the herbs. In particular, the inventive climate control jar 10 maintains marijuana fresh. The climate control jar 10 comprises two main systems for humidity control and for air distribution. The humidity control system controls the level of humidity within the jar 10, where the airlock system controls air distribution therein. Once closed, the airlock system prevents air from entering (or leaving) the internal volume of the jar 10. These two inventive systems can maintain marijuana fresh for up to one year within the jar 10.

Moreover, storing marijuana in the inventive jar over a temperature range of 68° to 72° F., preferably 70° F., will not damage the marijuana. And by use of the jar's airlock system, a "burping" procedure may be implemented that further supports maintaining the stored marijuana fresh, which will be welcomed by the commercial industry. A procedure called "burping" may be used with the inventive jar by opening the top cover of the jar or multiple storage jars in a commercial facility, at a regular interval, such as every 30 days, 60 days or 3 months, and resenting the air lock system to allow the stored marijuana to breathe. This procedure resets and restarts storage time, such that the layering system will bring a fresh supply of air into the stored marijuana in the bottom part slowly (see below for more details on the layering system). This feature combined with the hydrating function provided by humidifier pack prevents the marijuana from losing water weight while stored in the inventive jar(s).

The inventive climate control jar 10 comprises a top, climate control part 100, a top part cover 150 and a bottom part 200, the top, climate control part 100 including a layering system 105 to control flow and to release inside air slowly so such air movement does not change the level of potency or change the structure of the marijuana, tobacco, spices or other herbs stored therein. Once the airlock system (as described below in detail) is closed, no air is able to enter (or exit). A humidifier pack 110 may be stored in an internal volume of the inventive climate control jar 10 to control or maintain humidity, which supports long term storage.

The unique airlock system keeps the air in (and new air out), where a layering system 105 preferably is maintained in the top, climate control part 100, preferably comprising a set of plate-like structures 106, such as plates or disks, with vias arranged at various places on each surface or each plate to effect air flow through all the plates. The layering system operates somewhat like a baffle arrangement to prevent the air from moving too quickly (or too directly) through the layers (the plate-like layers with the via arrangements). In a preferred embodiment, the layering system has about seven different floors (or layers), each having a different position with holes 107 in selective places in each layer to provide the air to be constricted inside of the cap, so that the air can be released or communicated slowly through the various layers (plates) 106.

In an embodiment, the inventive climate control jar 10 is essentially a particularly constructed air-tight climate control jar 10 (See FIGS. 14, 16, 17, 18, 19) that functions to maintain marijuana, tobacco, herbs, spices etc. (which may be referred to hereinafter in the aggregate as "herbs"), fresh for up to one year with no complications to the herbs. In particular, the inventive climate control jar 10 is designed to maintain marijuana fresh for up to 1 year.

In an embodiment, the inventive climate control jar 10 comprises a top, climate control part 100, top part cover 150 and a bottom part 200, where the top, climate control part 100 includes a layering system 105 (FIGS. 15, 21) to control and release inside air (i.e., air within the internal volume) slowly so such air movement does not change the level of potency or change the structure of the marijuana or of other herbs stored therein. And as mentioned, once the airlock system is closed, no air is able to enter (or exit) the climate control jar 10, where the humidifier pack 110 stored in an internal volume, controls or maintains humidity. The inventive humidity control, i.e., the humidifier pack 110 and airlock feature for air distribution operate together to maintain the marijuana or other herbs stored therein at its optimal humidity for long term storage. For optimal storage of marijuana, a particular humidifier pack 110 is selected to maintain the level of humidity at approximately 55%-70%, preferably at a humidity level of 60% to 64%, and most preferably at a humidity of 62% inside of the jar 10; such humidity percentages are ideal for storage of marijuana.

The unique airlock system keeps the air in (and new air out). The layering system 105 preferably is arranged in the top, climate control part 100 and includes plate-like layers 106 with air flow openings 107 arranged in specific patterns so that the layering system operates somewhat like a baffle arrangement to prevent the air from moving quickly (or directly) through the layers. In a preferred embodiment, the layering system 105 may include from 4 to 10 layers, preferably 6-8 layers, and most preferably 7 layers. Each layer 106 is placed in a different position with holes 107 in selective places in each layer to control airflow to be constricted inside of the top, climate control part 100. As such, air-flow can be controlled for slow exchange through the various layers 105 between the top, climate control part 100 and an interior volume of the bottom, container part 200.

These and other features and advantages of the invention are illustrated in the following drawings and are further described in the Detailed Description, which follows, the scope of which is identified in the appended claims.

DETAILED DESCRIPTION OF THE OF THE PREFERRED EMBODIMENTS

The following detailed description of the preferred embodiments of the invention will be made in reference to the accompanying drawings, the scope of which are described in the accompanying claims.

Figure 1:
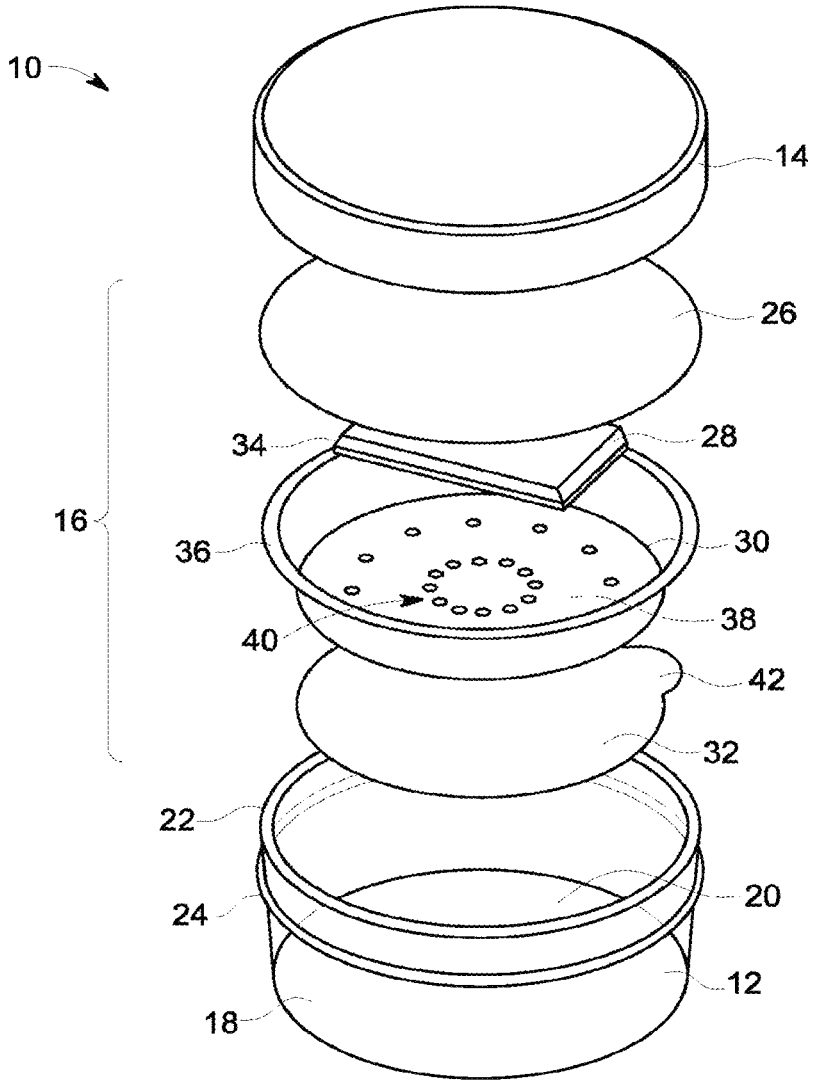
Fig. 1 (Prior Art)
FIG. 1 is a reproduction of a permeable container presented in FIG. 1 of the PRIOR ART '243 application.
Figure 2:
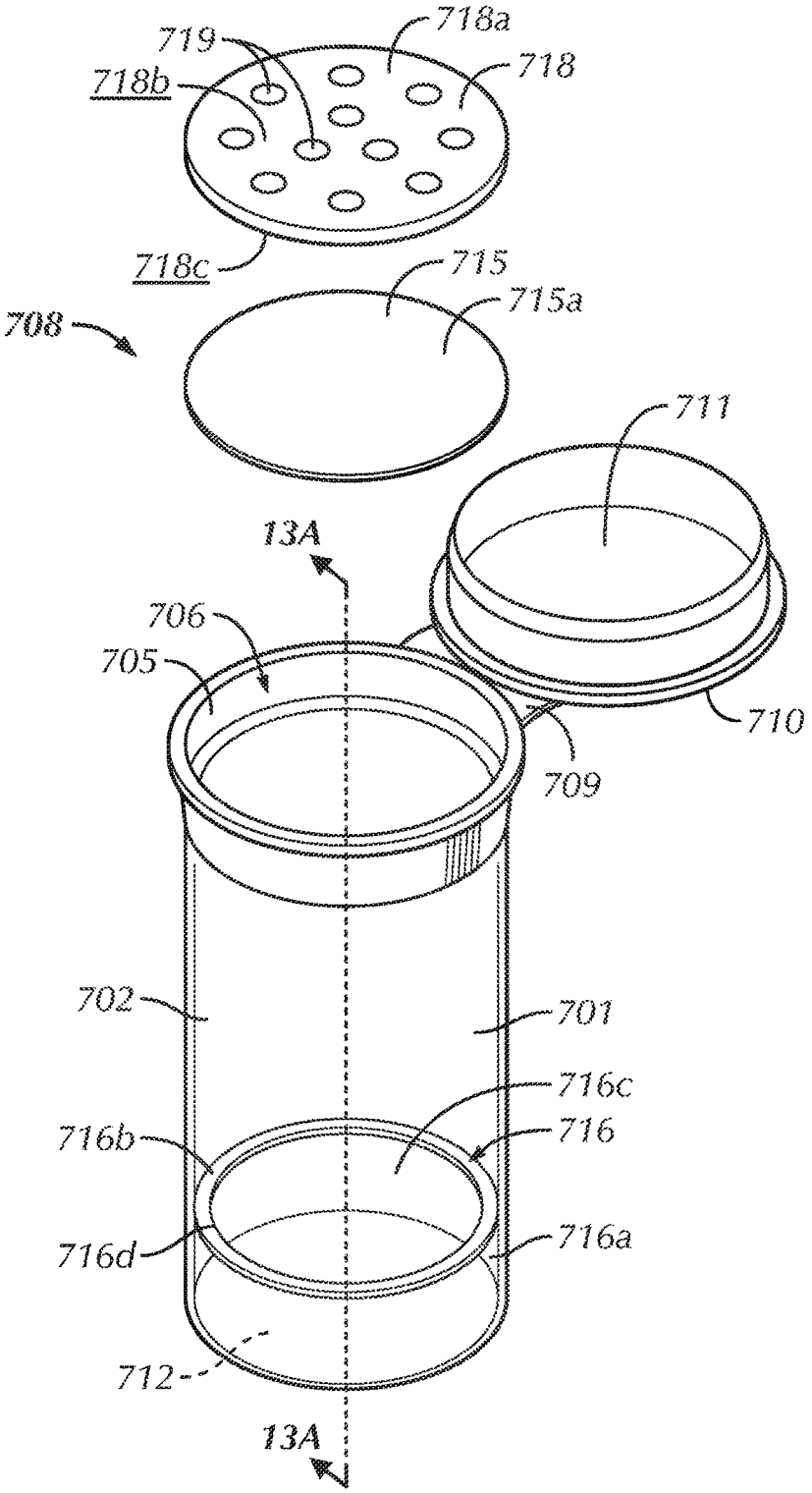
Fig. 2 (Prior Art)
FIG. 2 is a reproduction of a container assembly presented in FIG. 13 of the PRIOR ART '585 patent.
Figure 3:
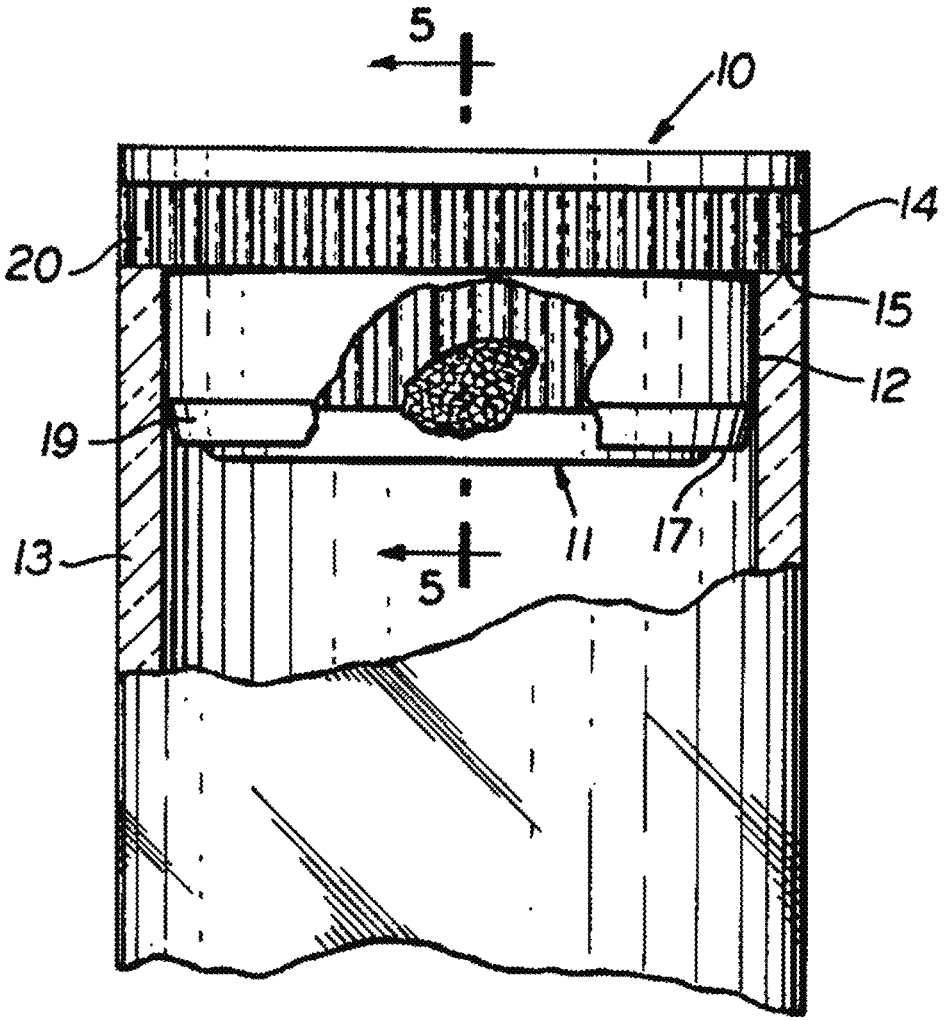
Fig. 3 (Prior Art)
FIG. 3 is a reproduction of an absorbent storage insert for a container cap presented in FIG. 1 of the PRIOR ART '137 patent.
Figure 4A:
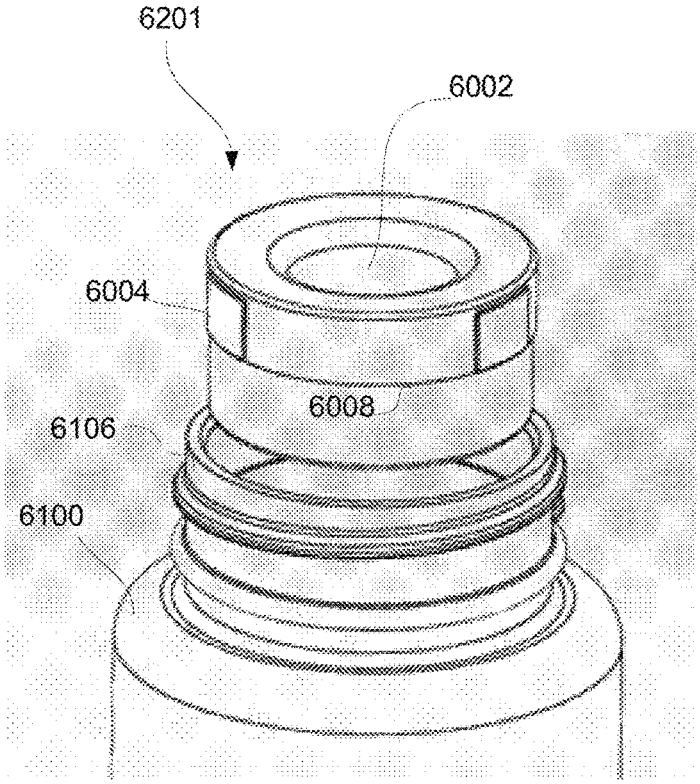
Fig. 4A (Prior Art)
FIGS. 4A and 4B are reproductions of bottle inserts presented in FIGS. 63 and 64 of the PRIOR ART '557 application.
Figure 4B:
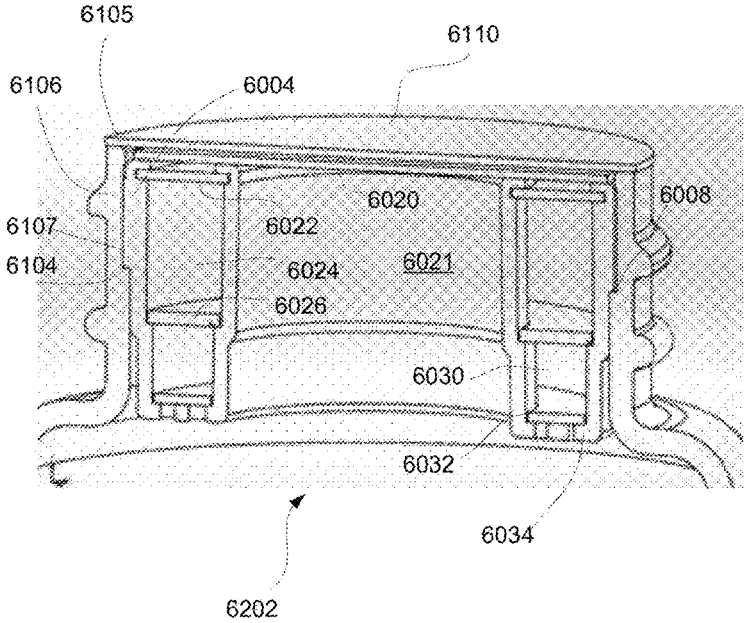
Fig. 4B (Prior Art)
Figure 5A:
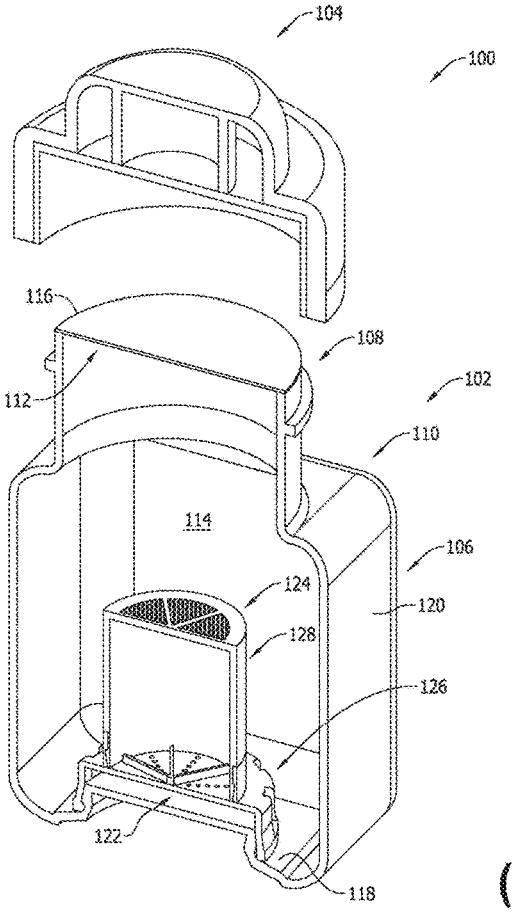
Fig. 5A (Prior Art)
FIGS. 5A and 5B are reproductions of a medicine container presented in FIGS. 1 and 2 of the PRIOR ART '442 application.
Figure 5B:
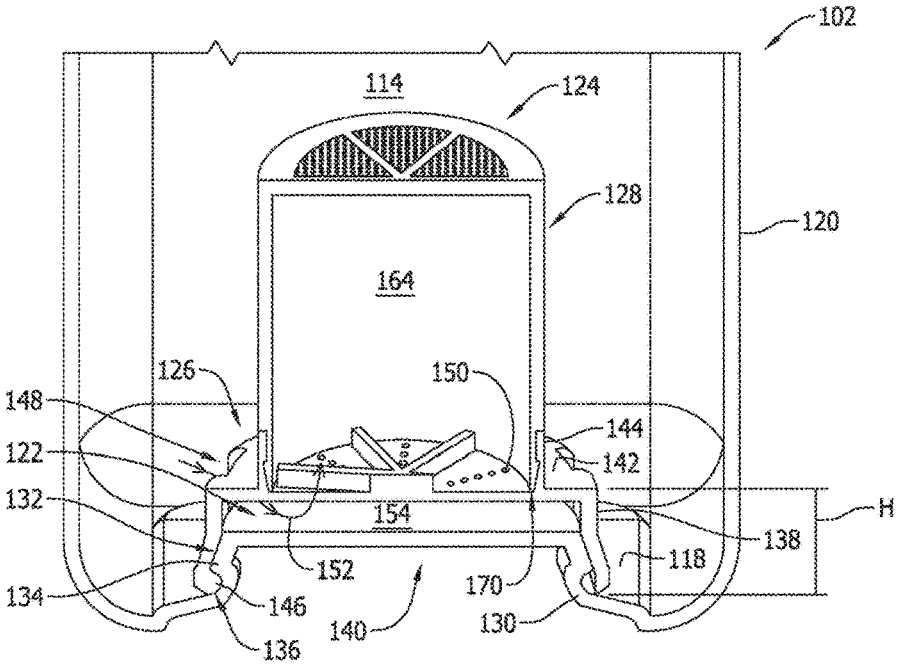
Fig. 5B (Prior Art)
Figure 6:
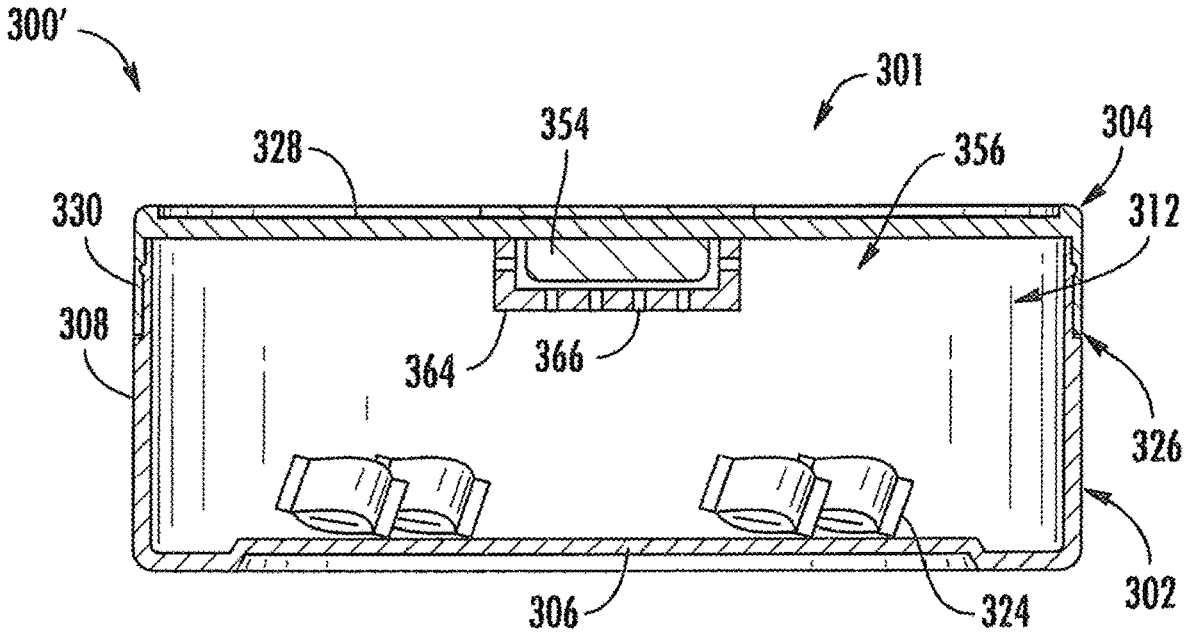
Fig. 6 (Prior Art)
FIG. 6 is a reproduction of a package presented in FIG. 11 of the PRIOR ART '130 patent.
Figure 7:
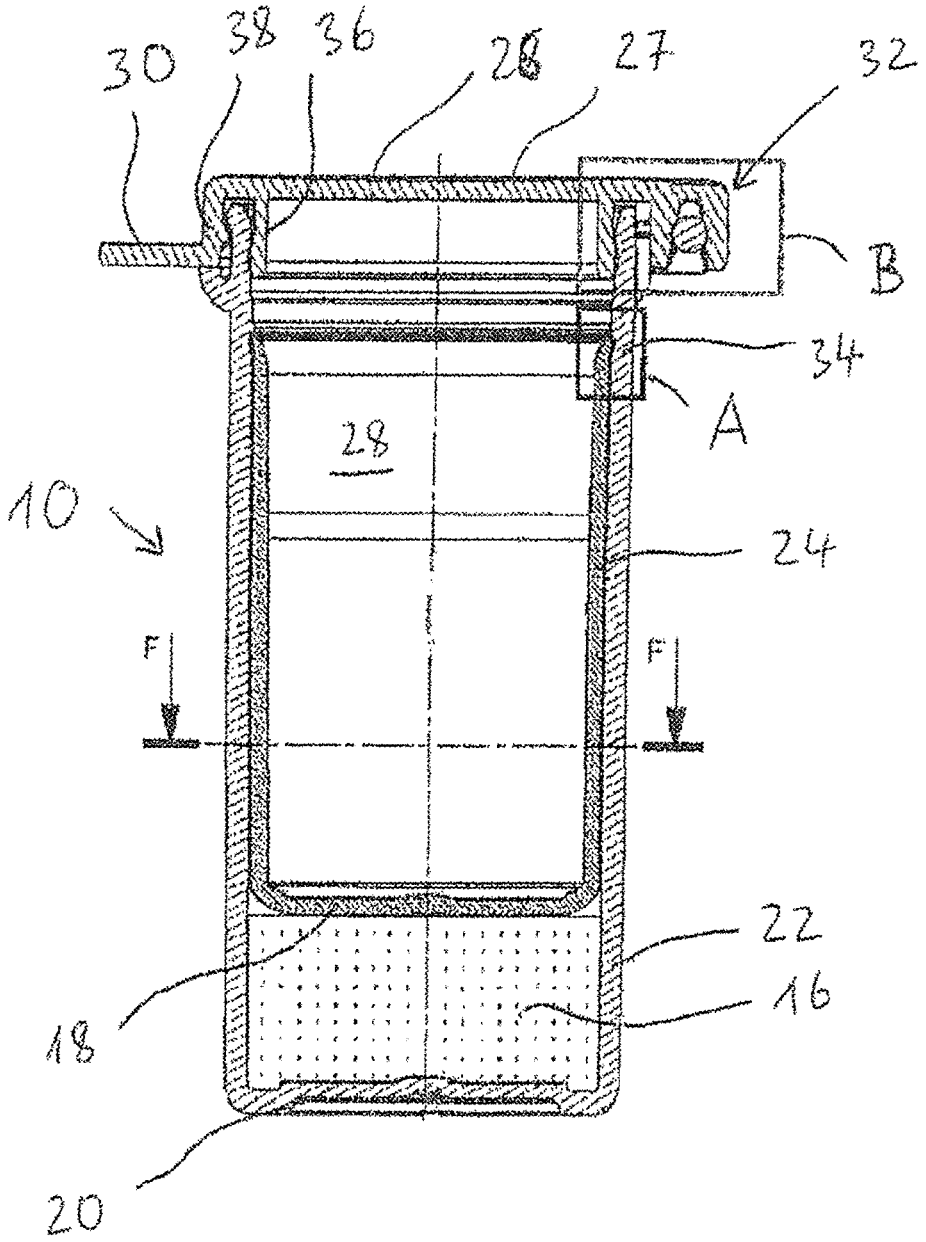
Fig. 7 (Prior Art)
FIG. 7 is a reproduction of a container presented in FIG. 2 of the PRIOR ART '241 patent.
Figure 8A:
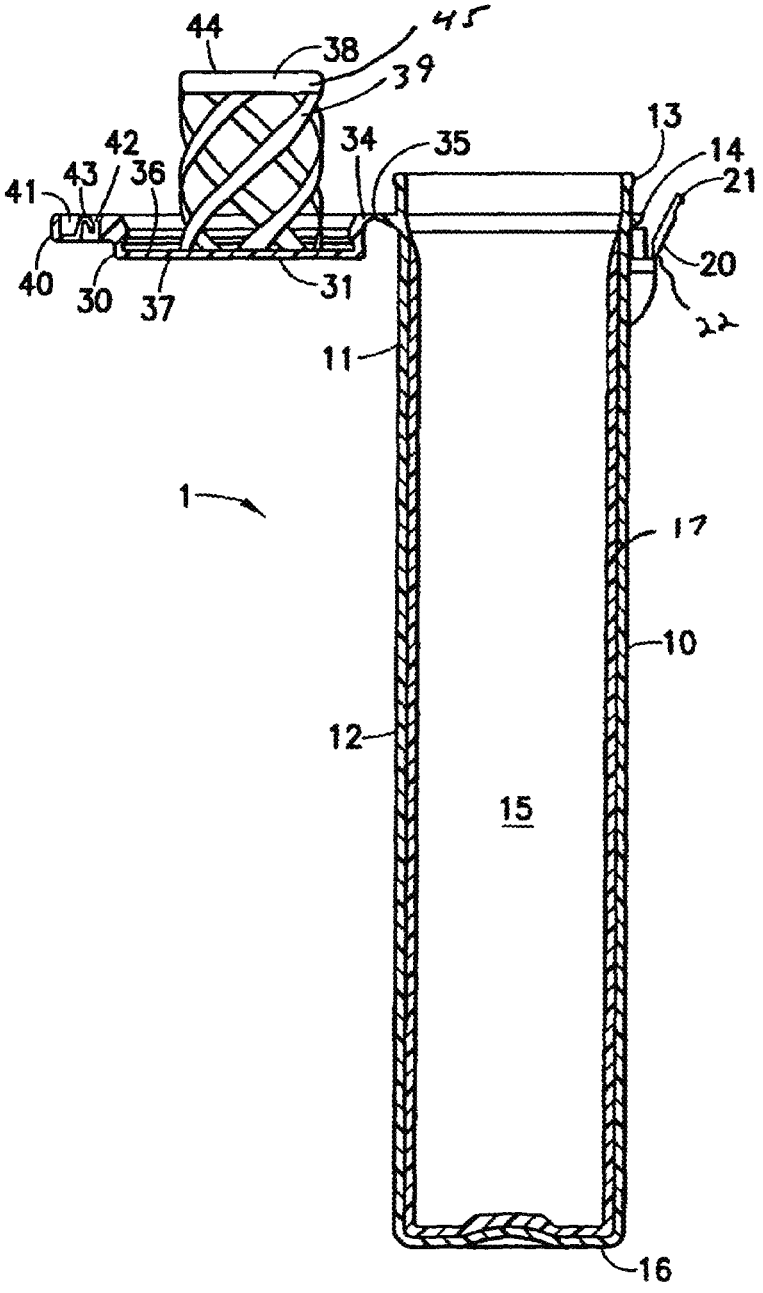
Fig. 8A (Prior Art)
FIGS. 8A and 8B are reproductions of a permeable container presented in FIG. 1 of the PRIOR ART '083 patent.
Figure 8B:
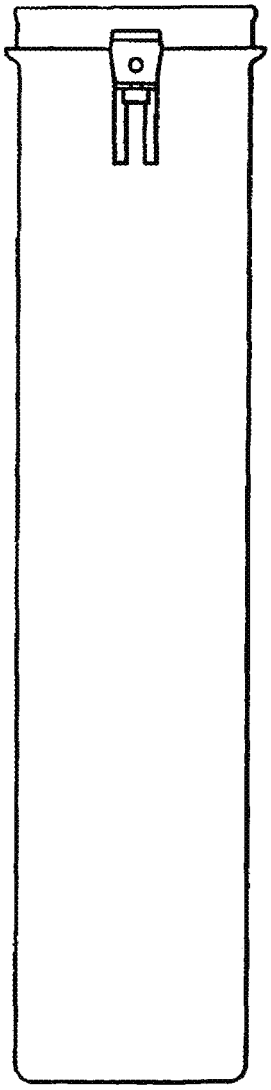
Fig. 8B (Prior Art)
Figure 9A:
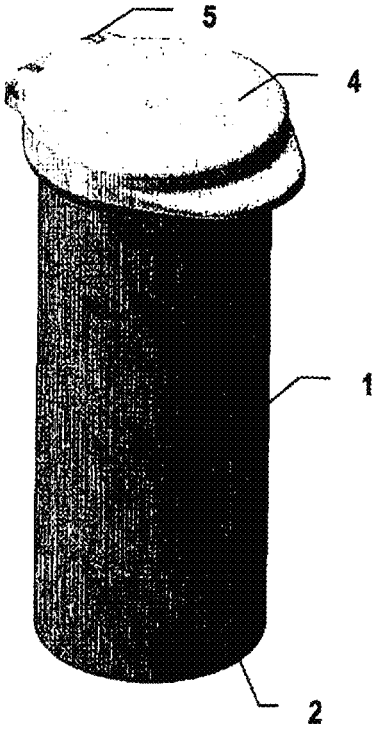
Fig. 9A (Prior Art)
FIGS. 9A, 9B, 9C are reproductions of a desiccant container presented in FIGS. 1, 2 3 of the PRIOR ART '735 application.
Figure 9B:
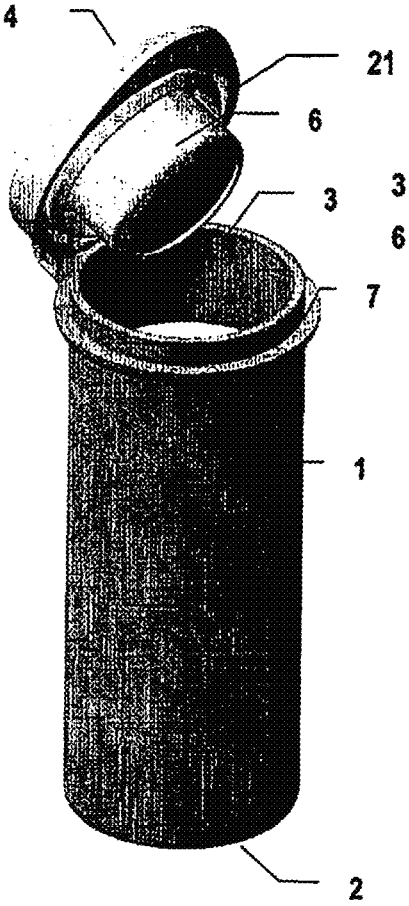
Fig. 9B (Prior Art)
Figure 9C:
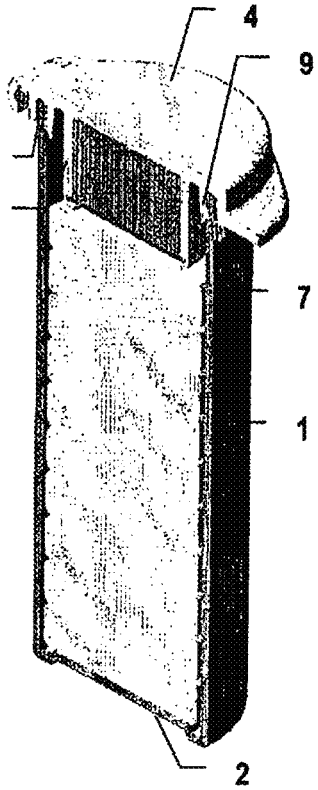
Fig. 9C (Prior Art)
Figure 10:
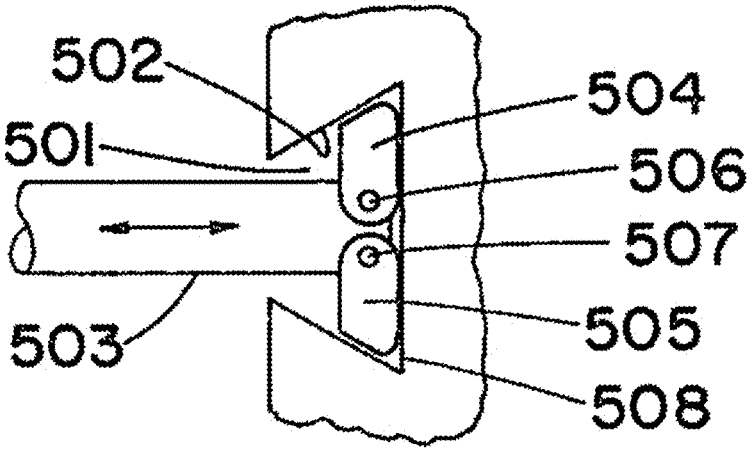
Fig. 10 (Prior Art)
FIG. 10 is a reproduction of a transparent enclosure presented in FIG. 5C of the PRIOR ART '508 application.
Figure 11:
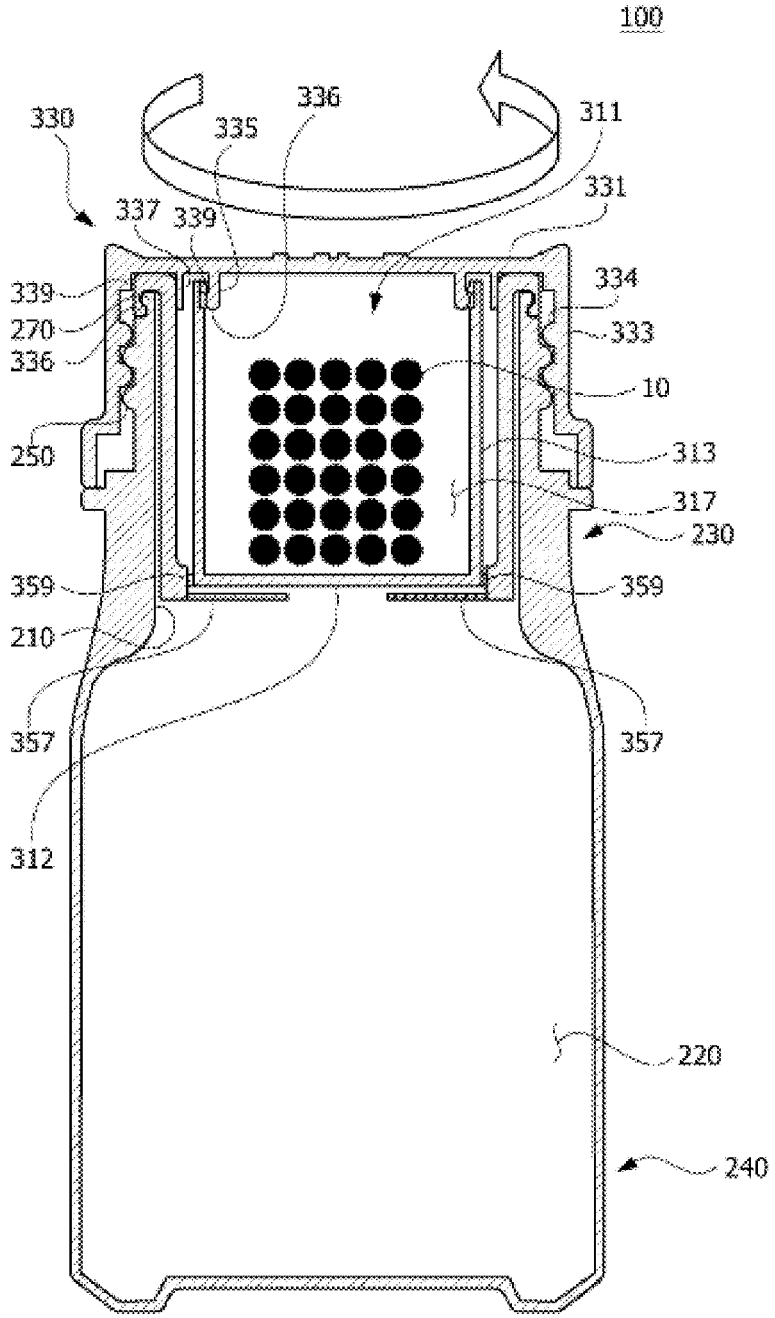
Fig. 11 (Prior Art)
FIG. 11 is a reproduction of a cover assembly presented in FIG. 2 of the PRIOR ART WO '507 application.
Figure 12:
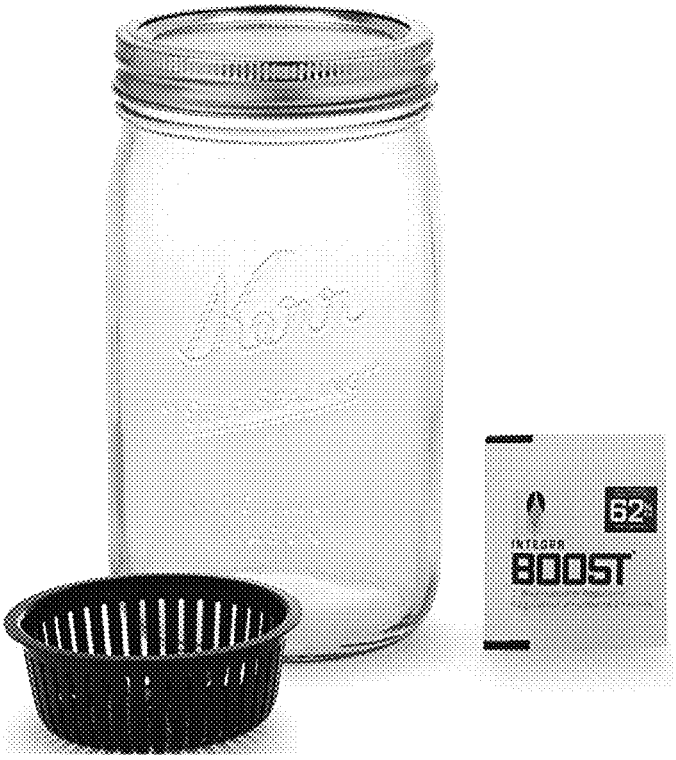
Fig. 12 (Prior Art)
FIG. 12 is a reproduction of a wide mouth mason jar presented in the PRIOR ART NPP non-patent literature.
Figure 13:
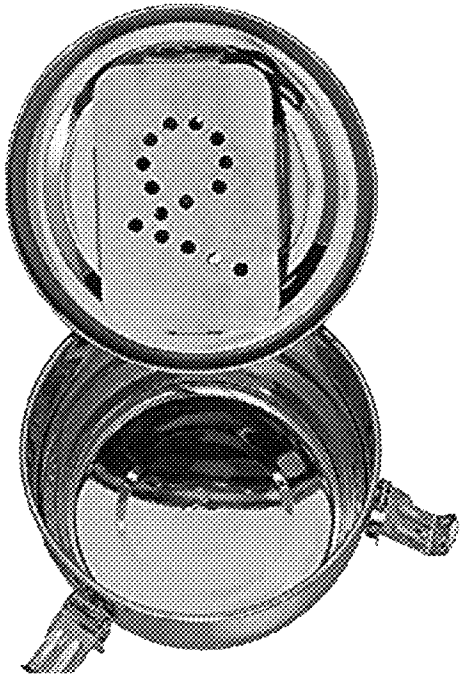
Fig. 13 (Prior Art)
FIG. 13 is a reproduction of a humidity control airtight stash container presented in the B001BN4 container PRIOR ART non-patent literature.
Figure 14:
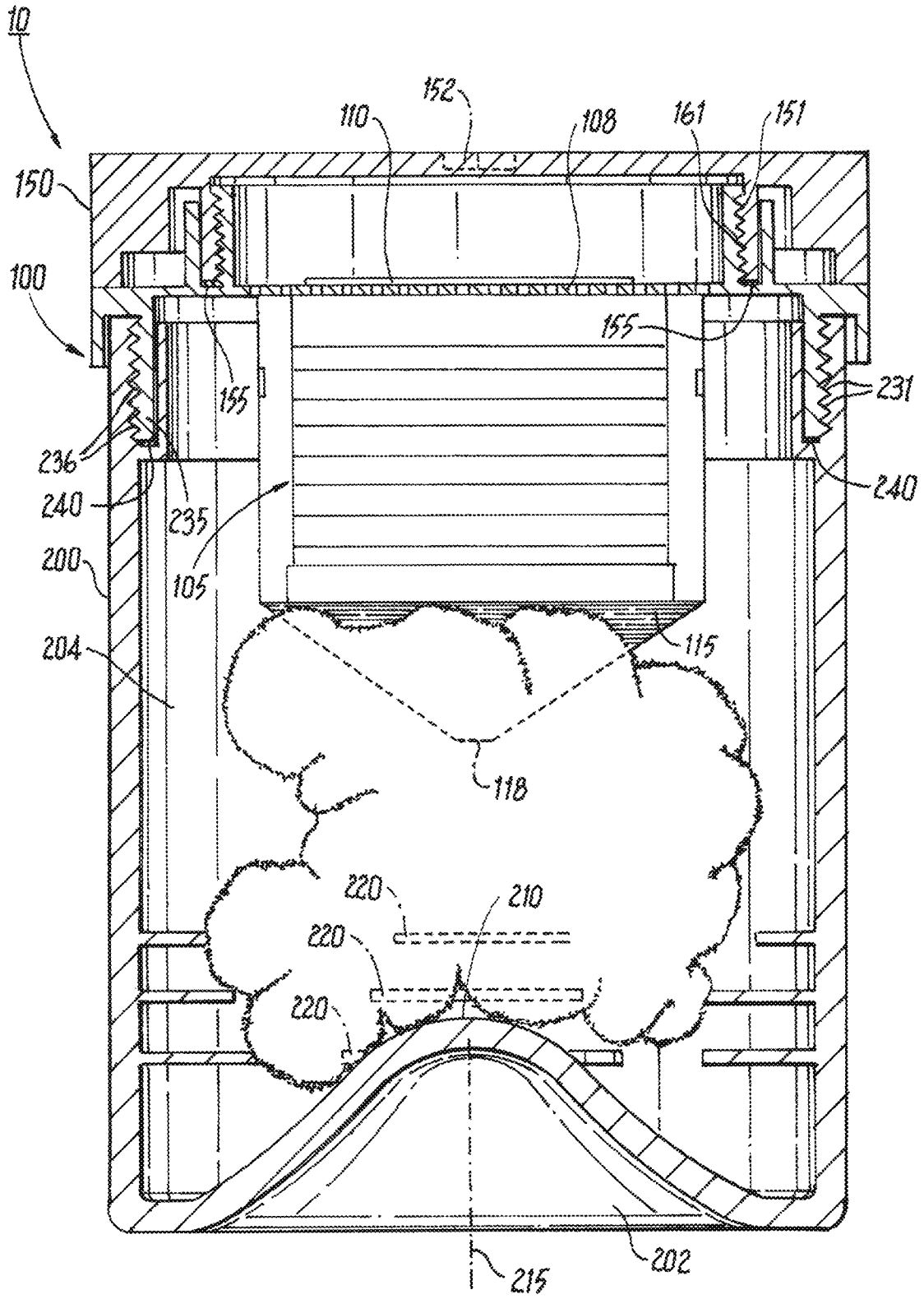
FIG. 14 illustrates a front, elevational, cross-sectional view of an embodiment of the inventive climate control jar of the invention.
Figure 15:
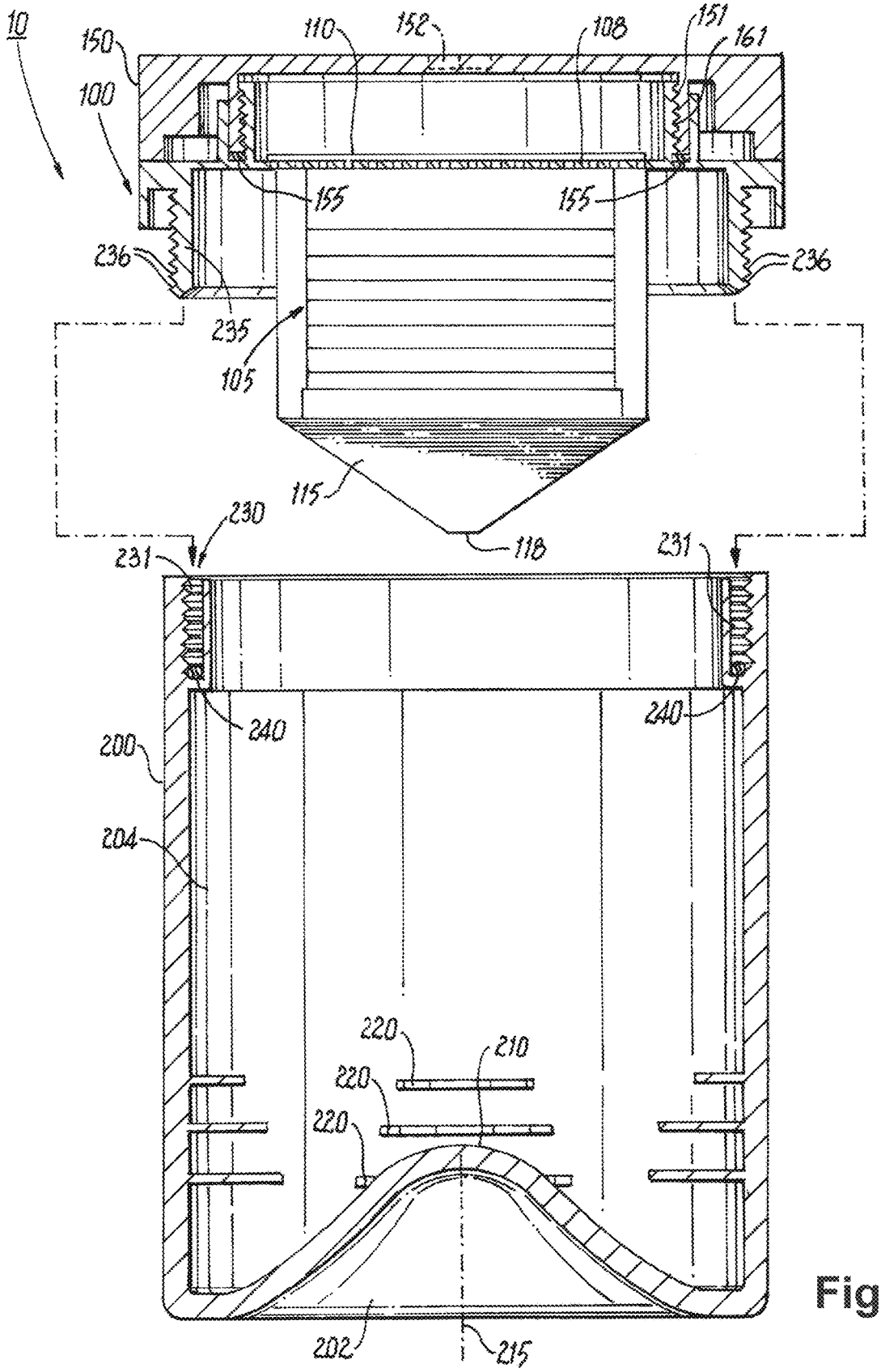
FIG. 15 illustrates a separated, front, elevational, cross-sectional view to highlight the top, climate control part, and the bottom, container part of the climate control jar of FIG. 14.
Figure 16:
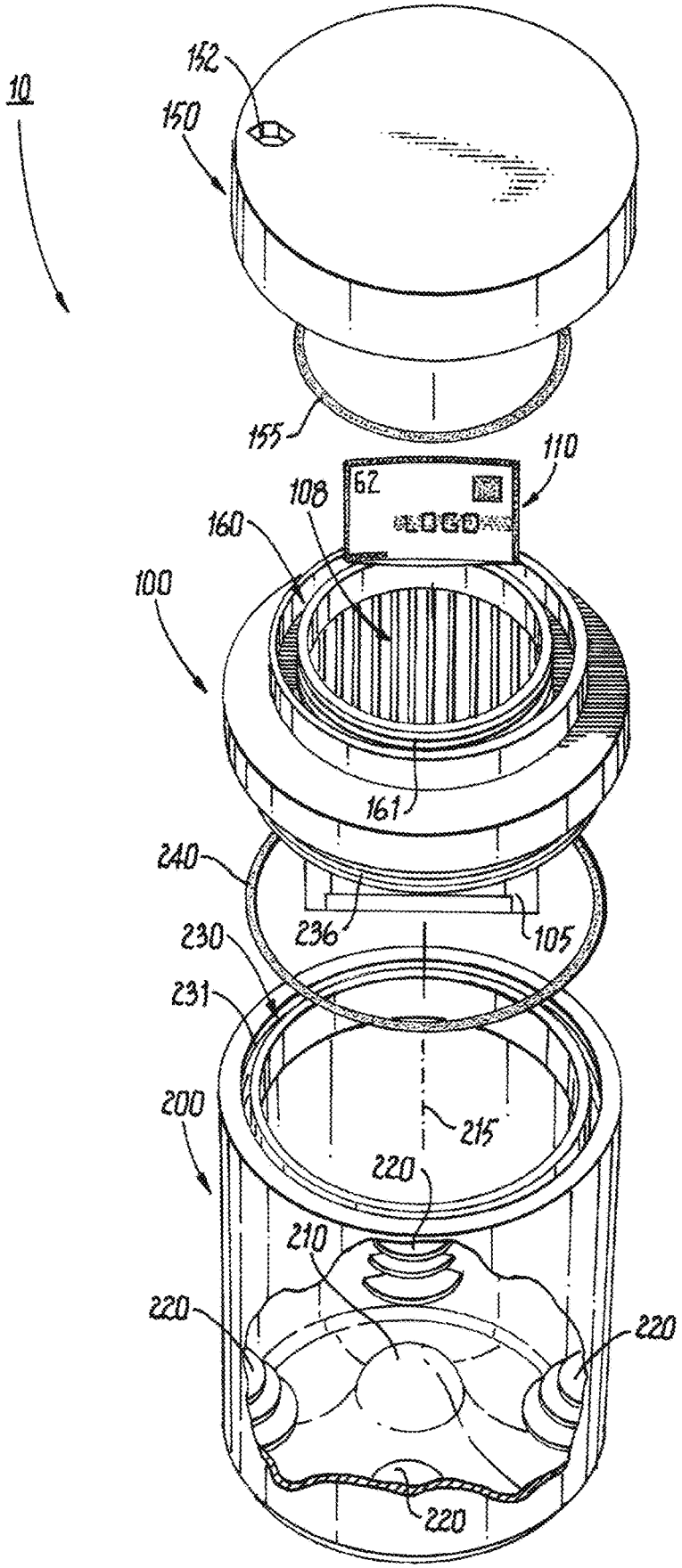
FIG. 16 illustrates a top, front side, exploded perspective view of the climate control jar of FIG. 14.

As shown in FIGS. 14-21, the inventive climate control jar 10 comprises a top, climate control part 100, a top cover part 150 and a bottom, container part 200. By its construction, the inventive climate control jar 10, includes two main systems for humidity control and for air distribution. The humidity control system, controls humidity of the environment in the bottom container part 200, and the airlock function of the top cover 150, which, once locked, prevents air from entering the internal volume of the container 200 (or air present therein from exiting). Preferably, the top, climate control part 100 includes a layering system 105 to control and exchange air between the top, climate control part 100 and the bottom, container part 200 slowly, so such air movement does not change the level of potency or change the structure of the marijuana or other herbs stored in the bottom, container part 200. Preferably, as illustrated in FIG. 16, a humidifier pack 110 may be inserted and arranged on a grate 108 that is part of the top, climate control part. The humidifier pack 110 is thereby stored in an internal volume of the container part 200 the inventive climate control jar 10, when assembled as a unit, to control and maintain the humidity of the internal volume of the container part 200 (and the marijuana or other herbs stored therein, as illustrated in FIG. 14).

Figure 19:
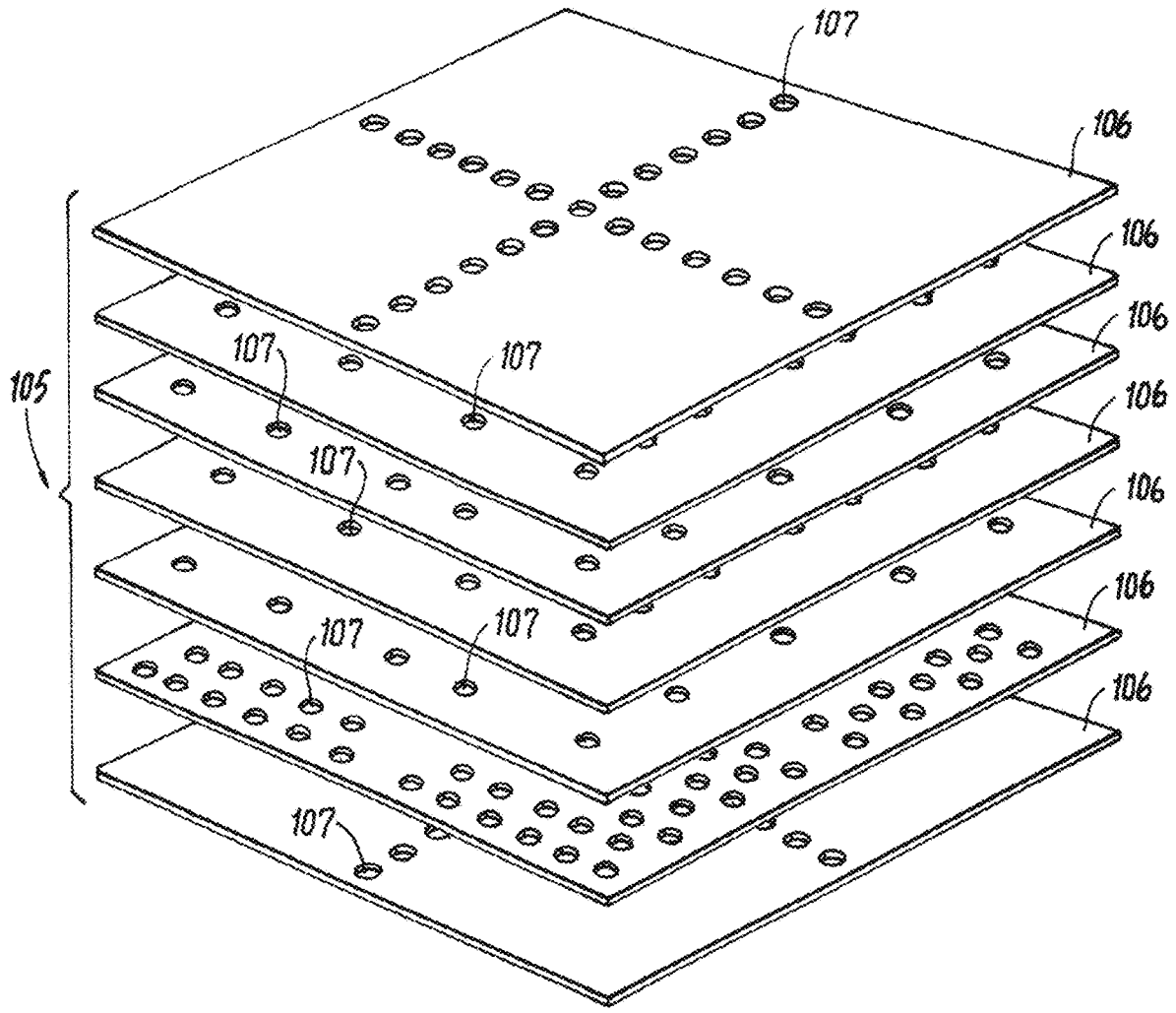
FIG. 19 illustrates perspective, exploded view of a set of 7 plate-like layers of the layering system of the climate control part.
Figure 20:
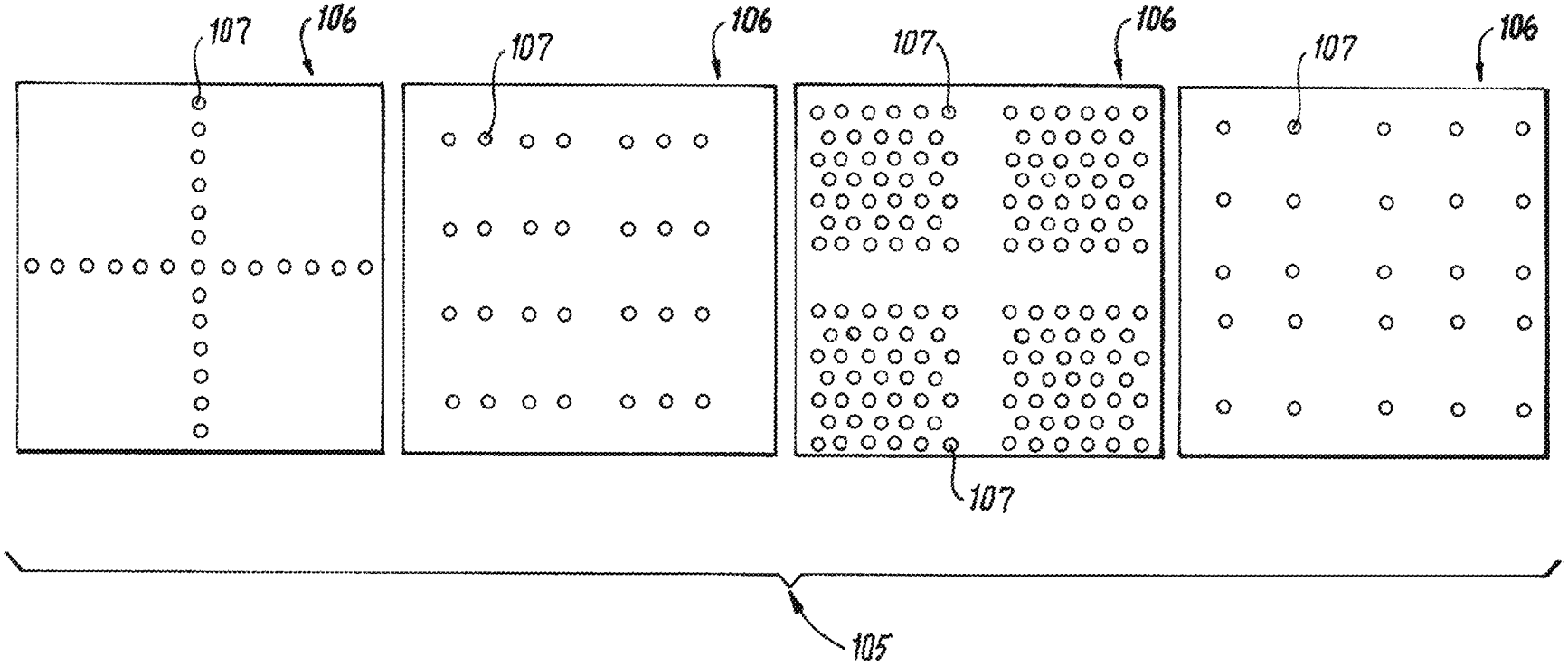
FIG. 20 illustrates top plan views of each of the plate-like layers of the 7 layering system of FIG. 6.
Figure 21:
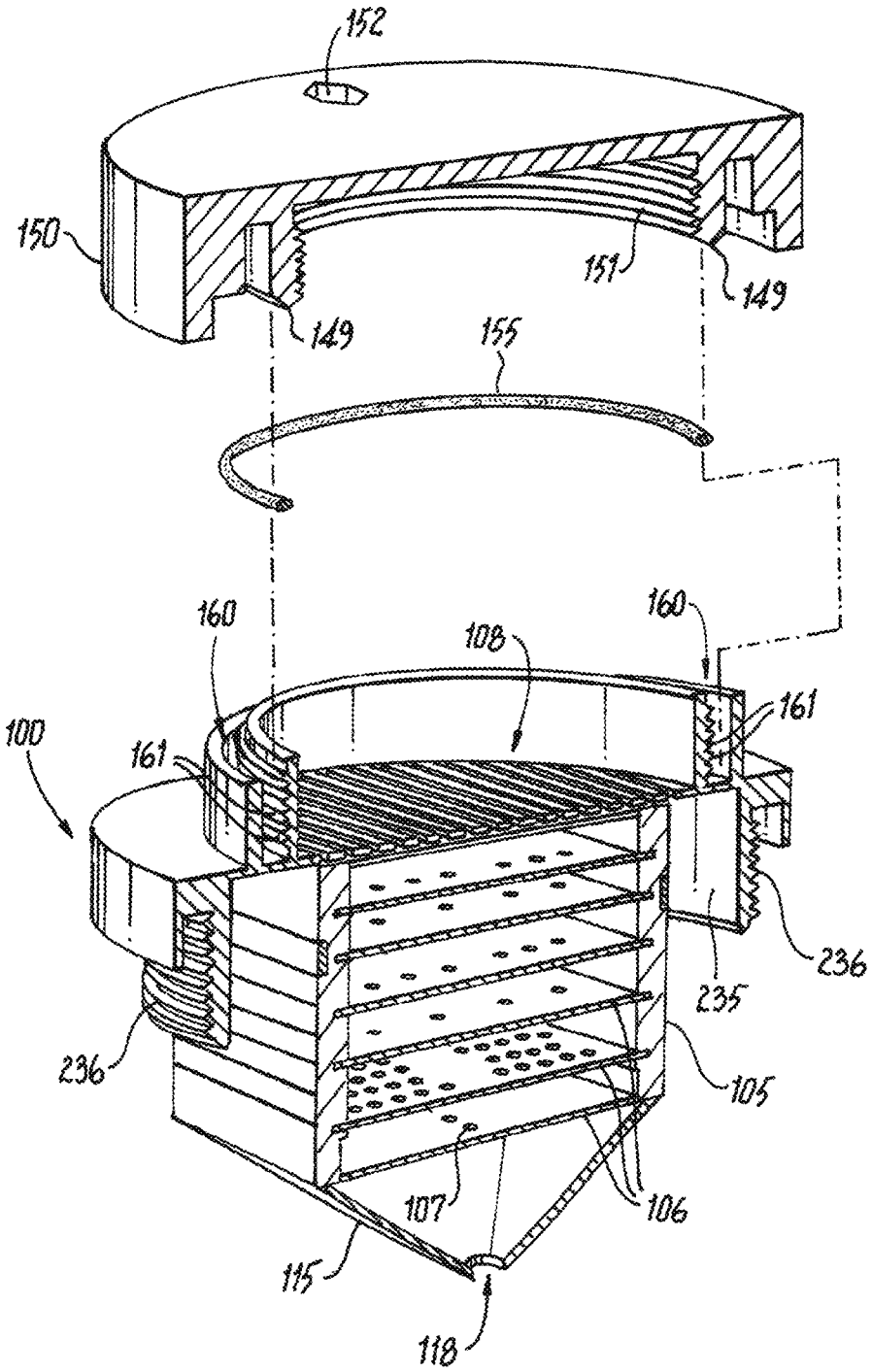
FIG. 21 illustrates an exploded cross-sectional, perspective cut-away view of the top, cover part and the top, climate control part and layering system of the inventive climate control jar.

As illustrated in FIGS. 19, 20 and 21, the layering system 105 is maintained in the top, climate control part 100, and includes plate-like separators 106 that function to define layers with air flow openings patterned so that the layering system operates as a baffle to prevent the air from moving quickly (and directly) through the layers. Please note, however, that while the layering system 105 is arranged in the container part 200 upon assembly of the top, climate control part 100 with the bottom, container part 200 as a complete storage unit, the layering system also might be arranged as part of the bottom, container part 200, without deviating from the scope and spirit of the invention. The layering system 105 may include from 4 to 10 layers, preferably includes 6-8 layers, most preferably includes 7 layers, as illustrated in FIGS. 19 and 21.

As illustrated in FIGS. 14, 15 and 21, the bottom 115 of the top, climate control part 100 may be shaped like a pyramid, or a cone that includes an opening 118 for limited fluid (e.g., air) communication at the very bottom tip. The size of the opening 118 is preferably 45 mm in diameter but may vary from 35-80 mm in diameter, so air moving down through the layering system 105 can be exchanged with the interior volume of the bottom, container part 200. As viewed from the side, the bottom, container part 200, to which the top, climate control part 100 attaches, has a bottom surface that preferably, is not planar, but preferably rises up as a mound-like curvature 210 arising out of a central part of a bottom surface 202 of the bottom, container part. The mound-like curvature rises to an apex 210 at a central midline 215, as illustrated in FIGS. 14, 15. Side-fins 220 preferably are a series of semi-circular, partial disk-like portions, extending radially from the inner side cylindrical surface 204 of the interior of the bottom, container part 200. Preferably there are a series of four groupings of 3 side-fins located around the interior periphery 204 of the bottom, container part 200. Consequently, as illustrated in FIG. 14, the herb is dropped into the bottom of container part 200, the elevated center 210 and side-fins 220 raise the herb to provides a superior ventilation and presentation inside the container part 200, when the stored marijuana is viewed from above.

FIGS. 14, 15, 17 and 18 highlight the top, climate control part 100, of climate control jar 10 with the with top cover 150 attached. When the top cover 150 is removed to access the internal volume of the top, climate control part 100, and as illustrated in FIGS. 14-16 and 21, the grate 108 overlying the layering system 105 is accessible, allowing a humidifier pack 110 (62% humidity for marijuana) to be placed on the grate 108, positioned on top of the layering system 105, to maintain the humidity of the air inside the climate control jar 10. The top cover 150 detachably connects and closes the top, climate control part 100 to assure that no air is allowed in or out once the top cover 150 is closed.

As illustrated in FIG. 21, the top cover 150 includes a lower ring-like rim 149 extending down from the cover for insertion into a circular channel 160 in the top, climate part 100. The circular channel 160 is configured to receive the ring-like rim 149 resulting in a substantially airtight fit between the two. Preferably, an outer surface of the lower ring-like rim 149 is configured with screw threads 151 and an inner surface of the circular channel 160 is configured with complementary screw threads 161 enabling the releasable connection between the top cover 150 and the top, climate control part 100. Preferably, a gasket or O-ring 155 is positioned in the circular channel 160 in the top, climate control part 100. The O-ring 155, the lower most edge of the ring-like rim 149 of the top, cover part 150 abuts and creates a seal with the circular channel 160 in the top, climate part 100, when the top cover part 150 and top, climate control part 100 are assembled as a closed unit. The gasket or O-ring 155 forms the air-tight seal when the unit is assembled for storage. Alternatively, the gasket or O-ring 155, rather than being arranged in the circular channel 160, is instead affixed to the bottom surface of the ring-like rim 149 of top, cover part 150, and forms an air-tight seal when the ring-like rim 149 of the top, cover 150 is inserted into the circular channel 160 and turned. The gasket or O-ring 155 may be affixed to the bottom surface of the ring-like rim 149 of top cover 150, by various means known in the art, such as, by the use of an adhesive, or by a physical attachment by, for example inserting the O-ring in a complementary groove (not shown) at the bottom of the ring-like rim 149 of the top cover 150.

As illustrated in FIGS. 14 and 16, when a user opens the inventive climate control jar 10 by removing the top cover 150 and removing the top, climate control part 100 from the bottom, container part 200, an inner circular slot 230 can be seen at the very top surface of the bottom part 200. A ring-like rim 235 is formed at the lower periphery of the top, climate control part 100, which is inserted into the inner circular slot 230 and rotated to effect closure. To that end, an outer side surface of the lower ring-like rim 235 is provided with screw-like threads 236 and an inner side surface of the slot 230 is provided with complementary screw threads 231 for receiving the screw threads 236 and creating an airtight seal when the top part 100 is rotationally closed upon the bottom part 200. Preferably, there is arranged proximate a bottom of the slot 230 an O-ring or gasket 240 so that when a bottom-most edge of the circular rim 235 of the top, climate control part 100 contacts the gasket or O-ring 240, an airtight seal is created preventing air from entering or leaving the jar 10 (once it is closed). Alternatively, as described with regard to the top cover 150, the gasket or O-ring 240, rather than being arranged in the slot 230 in the bottom part 200, may be instead affixed to the bottom surface of the circular rim 235, which is inserted into the slot 230 to form an air-tight seal when the circular rim is inserted and turned. In an alternative embodiment a combination of an O-ring and a gasket may be employed at either the top cover 150 or bottom part 200 for an even better seal.

As should be understood from FIGS. 15, 17, 18 and 21, to close the jar, the user will turn (preferably clockwise) to screw down the top, climate control part 100 (with the top cover 150 attached) into the bottom part 200 of the jar, so that it abuts against gasket or O-ring 240 and prevent the air from coming in or out of the inventive climate control jar 10. As such, this inventive jar 10 provides a dual air-lock system, where the first one is where the top cover 150 connects to the top, climate control part 100, and the second is where the top, climate control part 100 connects to the bottom part 200 of the jar, as explained above.

The upper airlock system is closed by rotating the top cover 150, preferably by hand thereby pressing the gasket or O-ring 155 between the top cover 150 and the top, climate control part 100 to form an air-tight seal. In a preferred embodiment, to more easily close and seal the top cover 150 against the top, climate control part 100, and to assist in opening the top cover 150, a closing mechanism is provided, which includes a hex key opening 152, which is closed at its bottom, on the top surface of the top cover 150, preferably towards the edge of the cover 150. A complimentary hex key (also known as an Allen key) (not shown), may also be provided. Using the closing mechanism and hex key opening 152, the hex key is used to assist the user to tighten the top cover 150, and to open the top cover 150 so that it can be more easily unscrewed to break the seal and separate the top, cover part 150 from the top, climate control part 100. Users may also twist the top cover 150 with their hands to open and close the top cover 150 and the top, climate control part 100 with or without the assistance of the hex key and hex key opening 152.

Figure 17:
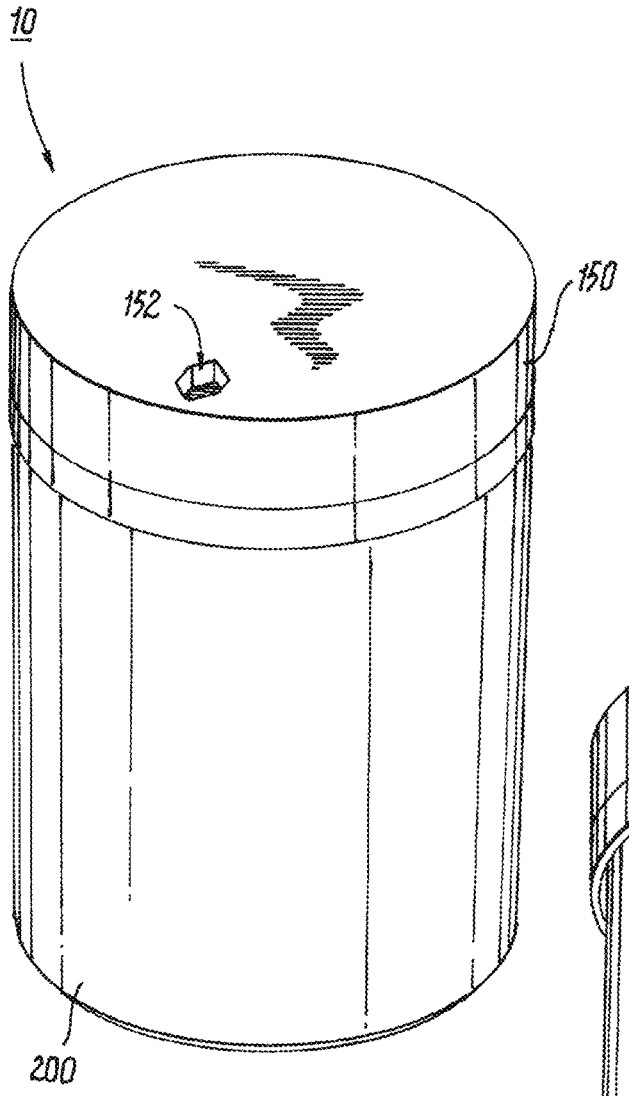
FIG. 17 illustrates an upper, front perspective view of the inventive climate control jar.
Figure 18:
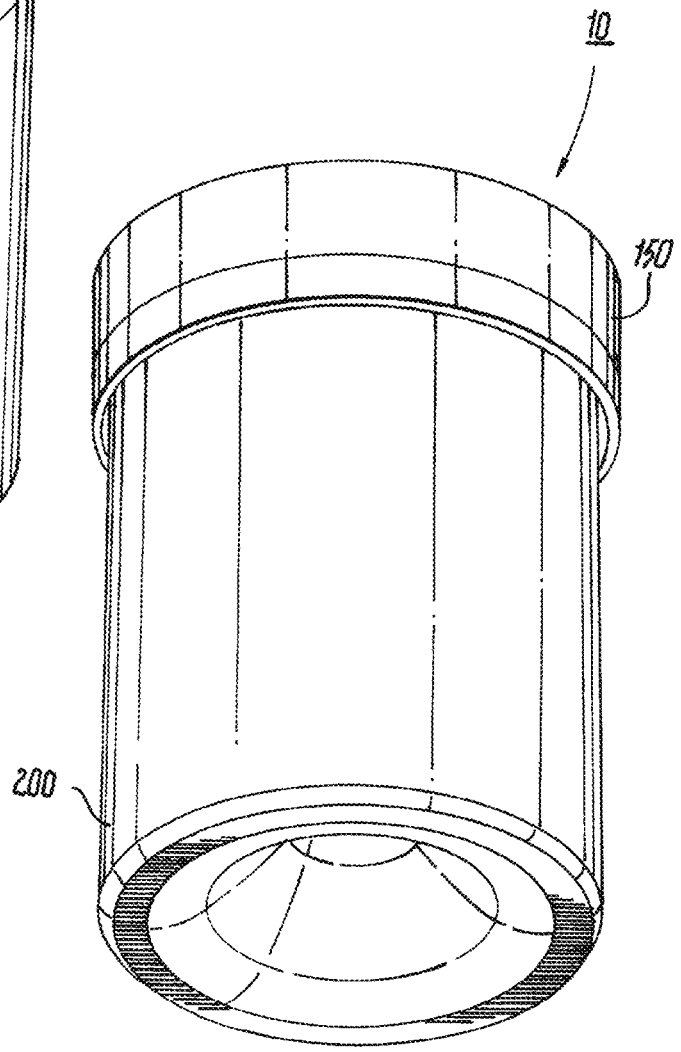
FIG. 18 illustrates a lower, front perspective view of the inventive climate control jar.

FIGS. 17 and 18 show the inventive jar 10 in a closed state, to illustrate outer profile of the jar 10 and highlight its structure, and how the bottom surface of the bottom, container part 200 extends upwards.

FIGS. 19 and 20 highlight the functional operation of the layering system 105, comprising preferably 7 layers of air separator plates 106. More or less air separator plates 106 may be used to either increase or decrease the exchange of air. The differing air separator plates 106 function as different floors, with a different positions and different air opening patterns. In this way, the inside air (once the inventive climate control jar 10 is assembled into a closed unit) is constricted inside of the top, climate control part 100, contained within the upper portion of the bottom, container part 200. Consequently, the inside air must traverse a tortuous path through each of the air pattern openings 107 in each of the layered air separator plates 106. Accordingly, the air is exchanged very slowly between the top, climate control part 100, and the bottom, container part 200. This air flow is ideal for herbs such as marijuana, the storage of which requires air flow to be controlled so that the humidified air exchanged in jar 10 fills up slowly and is not overwhelmed. Marijuana is preferably humified at 62% internal humidity, whereas tobacco products, such as cigars and loose tobacco are best maintained at 55% humidity, as well known by those skilled in the art.

FIG. 20 in particular illustrates the structure of the layered air separator plates 106. The first and seventh layers 106 have one pattern of (cross-like) openings 107, the second and fourth layers 106 comprise 4 sets of parallel line arrangements of the openings 107, the sixth layer 106 has four sections with multiple openings 107 and the third and fifth layers elements 106 have 5 vertical and horizontal lines of openings 107, in the exemplary embodiment. Preferably, the cross-like arrangements of the openings 107 of the first and seventh layer elements 106 should pose the greatest challenge for air to pass through. That is, in this arrangement, the humidified air shall pass through the openings 107 in a very tight sequence so that it is harder to exchange the air from floor to floor (sequentially layered, plate-like elements 106). The openings 107 in the different layers 106, preferably are not aligned between adjacent layers. The openings 107 are preferably 45 mm in diameter but may vary from 35-80 mm in diameter.

The exemplary sixth element or layer (floor) 106 has an air opening pattern that is readily distinguishable than those of layers 1 to 5 and 7. In layer 6, the openings 107 are in an arrangement where they can operate in the aggregate like a vortex for the air to bounce and stream through the many openings, functionally driving or pushing the air through the seventh element or layer and out of the bottom opening of the pyramidal system 105 (See FIGS. 20 and 21). That is where at the very tip of this up-side-down pyramidal (or conical) shape another opening 118 is located.

The humidifier pack 110 is shown in FIGS. 15 and 16 in the top, climate control part 100, is placed on a grate 108, above the layering system 105. For storage of marijuana, a particular humidifier pack 110 is selected which maintains the level of humidity inside of the jar 10 at a humidity level of approximately 55%-70%, preferably at a humidity level of 60% to 64%, and most preferably at a humidity of 62%, which is ideal for storage of Marijuana. The humidifier pack 110 may also include a minute amount of mildew or mold protector, as known to persons of ordinary skill in the art, such that at a preferred 60% or 62% humidity level, the Marijuana can stay locked in the jar 10 for up to a year, and be fresh as the day it was locked, at the one-year date.

Moreover, storing marijuana in the inventive jar over a temperature range of 68° F. to 72° F., preferably at 70° F., will not damage the marijuana. And by use of the jar's airlock system, a "burping" procedure may be implemented that further supports maintaining the stored marijuana fresh, which will be welcomed by the commercial industry. A procedure called "burping" may be used with the inventive jar by opening the top cover of the jar or multiple storage jars in a commercial facility, at a regular interval, such as every 30 days, 60 days or every 3 months, and resetting the air lock system to allow the stored marijuana to breathe. This procedure resets and restarts storage time, such that the layering system will bring a fresh supply of air into the stored marijuana in the bottom part slowly (see below for more details on the layering system). This feature combined with the hydrating function provided by humidifier pack prevents the marijuana from losing water weight while stored in the inventive jar(s) 10.

The foregoing description of various and preferred embodiments of the present invention has been provided for purposes of illustration only, and it is understood that numerous modifications, variations and alterations may be made without departing from the scope and spirit of the invention, as set forth in the following claims.

I claim:

1. A climate control container constructed to maintain herbs fresh for extended periods of time, the container comprising:

a container part configured with a cylindrical wall arising up from a cylindrical base to for an internal volume for receiving and storing herbs;

a top, climate control part configured for detachable air-tight connection to an upper portion of the cylindrical wall of the container part;

a layering system configured for removeable placement in an upper portion of the internal volume of the container part, the layering system comprising a plurality of plates in a top-down vertical arrangement, the plates formed with unique respective patterns of through-holes to limit air movement through the vertical arrangement in both up and down directions; and a top cover part for detachable, air-tight connection to an upper portion of the internal volume of the container part and/or the top, climate control part;

wherein air-tight connecting the top, climate control part to the container part, with the layering system placed in the upper portion of the internal volume and air-tight connecting the top cover part to the top, climate control part effects an air lock system that seals the internal volume preventing air flow in or out while also controlling air flow through the vertical arrangement to limit air turbulence within the internal volume.

2. The climate control container of claim 1, wherein the top, climate control part is further configured with a receiving section for receiving the layering system and wherein the layering system is formed with a seating portion to facilitate placement of the layering system in or upon the receiving section.

3. The climate control container of claim 1, further comprising a humidifier pack arranged in the internal volume.

4. The climate control container of claim 3, wherein the humidifier pack is arranged in the top, climate control part.

5. The climate control container of claim 4, wherein the humidifier pack is arranged on or above the layering system and the layering system on the top, climate control part.

6. The climate control container of claim 4, wherein the layering system includes a rack or grate element arranged at the system's vertical top and the humidifier pack is arranged on the rack or grate above the layering system on the top, climate control part.

7. The climate control container of claim 4, wherein the layering system includes a cone element below the bottom-most plate, wherein a diameter the cone decreases with its vertical descending extent into the internal volume, and wherein a tip of the cone includes an opening through which all air communicates between the layering system and the internal volume.

8. The climate control container of claim 7, wherein the opening in the tip varies between 35-80 mm in diameter.

9. The climate control container of claim 8, wherein the opening in the tip is 45 mm in diameter.

10. The climate control container of claim 1, wherein the plate through holes vary in diameter, length or width between 35-80 mm.

11. The climate control container of claim 10, wherein the plate through holes are 45 mm in diameter, length or width.

12. The climate control container of claim 1, wherein the top cover part includes a hex element that is turned with a hex wrench to assist in opening or closing the top cover and air-tight seal the top cover to the upper portion of the internal volume of the top, climate control part.

13. The climate control container of claim 1, wherein the base of the container part is non-planar, including a bottom surface that rises up as a curvature to an apex around the midline of base center, upon which the herb may be arranged.

14. The climate control container of claim 1, wherein an O-ring or gasket is included between the top cover and the top, climate control part, to support air-tight seal when detachably connected.

15. The climate control container of claim 1, wherein the herb is marijuana.

16. The climate control container of claim 1, further comprising one or more semi-circular, partial disk-like portions or side fins extending radially from an inner, side cylindrical surface of the bottom, container part.

17. The climate control container of claim 1, wherein the top, climate control part includes a downwardly extending circular rim arranged with screw-like threads and the bottom container part includes a circular slot at a top rim that is arranged with screw-like threads that complement those of the top, climate control part to effect and air-tight connection when the top, climate control part and the bottom container part are screwed together.

18. The climate control container of claim 1, the top cover part includes a downwardly extending circular rim arranged with screw-like threads and the top, climate control part includes a circular slot at a top rim arranged with screw-like threads that complement those of the top cover part to effect and air-tight connection when the top cover part and the top, climate control part are screwed together.

19. The climate control container of claim 18, wherein an O-ring or gasket is included between the top cover part and the top, climate control part, to support air-tight seal when they are detachably connected.

20. The climate control container of claim 19, wherein the O-ring or gasket is adhesively or physically attached to the bottom rim of the top cover part or the top, climate control part.

21. The climate control container of claim 17, wherein the O-ring or gasket is adhesively or physically attached to the bottom rim of the climate control part or in the circular slot in the bottom, container part.

* * * * *